US005608694A

United States Patent [19]

Grimm et al.

[11] Patent Number: 5,608,694

[45] Date of Patent: Mar. 4, 1997

[54] MECHANICAL TIMEPIECE PROVIDED WITH A TOURBILLON

[75] Inventors: Maurice Grimm; André Beyner, both of St-Blaise, Switzerland

[73] Assignee: Omega S.A., Bienne, Switzerland

[21] Appl. No.: 429,238

[22] Filed: Apr. 25, 1995

[30] Foreign Application Priority Data

May 7, 1994 [CH] Switzerland ..... 01424/94

[51] Int. Cl.[6] ..... G04B 15/00; G04B 19/20

[52] U.S. Cl. ..... 368/127; 368/77; 368/142

[58] Field of Search ..... 368/76, 77, 124–128, 368/139–144

[56] References Cited

U.S. PATENT DOCUMENTS

| | | | |
|---|---|---|---|
| 2,466,312 | 4/1949 | Heintz | 368/77 |
| 2,852,908 | 9/1958 | Stern et al. | 568/77 |
| 3,974,639 | 8/1976 | Gilomen et al. | 368/142 |

FOREIGN PATENT DOCUMENTS

| | | |
|---|---|---|
| 7965 | 1/1894 | Switzerland . |
| 30754 | 6/1904 | Switzerland . |
| 33368 | 8/1905 | Switzerland . |
| 262017 | 6/1946 | Switzerland . |

*Primary Examiner*—Vit W. Miska

*Attorney, Agent, or Firm*—Griffin, Butler Whisenhunt & Kurtossy

[57] ABSTRACT

A mechanical timepiece comprising a barrel meshing with a tourbillon, this timepiece being characterised in that the tourbillon is supported by its base solely by a bearing whose external ring comprises a toothing which acts as a fixed wheel for driving a satellite pinion of an escapement of the tourbillon.

10 Claims, 8 Drawing Sheets

MECHANICAL TIMEPIECE PROVIDED WITH A TOURBILLON

The present invention concerns a mechanical timepiece, in particular an automatic timepiece, provided with a tourbillon.

More particularly, it concerns a timepiece of the above-mentioned type, in which the tourbillon which is advantageously placed at the centre, is arranged so as to be entirely visible, to the user, from the side of the dial.

The present invention thus concerns a mechanical timepiece comprising a barrel meshing with a tourbillon, characterised in that said tourbillon is rotatably mounted inside said timepiece on a single pivot supporting said tourbillon by its base, this tourbillon which is suspended by its lower part on this single pivot being entirely free in its upper part.

This invention also concerns a mechanical timepiece comprising a side called the dial side, visible to the user for reading a horometric time, and a barrel meshing with a tourbillon, characterised in that said tourbillon is made visible from the dial side of said timepiece and is arranged at the centre of said timepiece.

According to another feature of the invention, the tourbillon which completes a revolution in one minute comprises a second hand which forms the rate adjustment index of this timepiece.

It is also to be noted that this timepiece comprises display discs which indicate the horometric time and which are mounted coaxially to said tourbillon.

This timepiece also comprises a dial ring fixedly mounted in a display dial, this ring forming the guide means ensuring rotational radial guiding of the display discs.

Further, the display discs are driven at their periphery by a driving device mounted on a frame formed by a case of said timepiece.

This timepiece further comprises toothed driving crowns which are respectively fitted at the periphery of the display discs.

This timepiece also comprises means for supporting the display discs, formed by brackets ensuring axial guiding of these discs.

The invention also concerns a mechanical timepiece comprising a barrel meshing with a tourbillon, characterised in that said tourbillon is supported by its base solely by a bearing whose external ring comprises a toothing which acts as a fixed wheel for driving a satellite pinion of an escapement of said tourbillon.

The invention also concerns a mechanical timepiece comprising a barrel meshing with a tourbillon, and means for displaying a horometric time, characterised in that it comprises a first gear-train forming the driving gear-train and ensuring the mechanical coupling between the barrel and the tourbillon, and a second gear-train forming the display gear-train driving the display means, this display gear-train meshing with time-setting means, the first driving gear-train and the second display gear-train both meshing directly with the barrel which constitutes a mechanical buffer between the two gear-trains avoiding any disturbance of the first gear-train when the time is being set.

The features of the invention will appear more clearly upon reading the following embodiment description, given here by way of example, in light of the attached drawings, in which.

Figure 1:
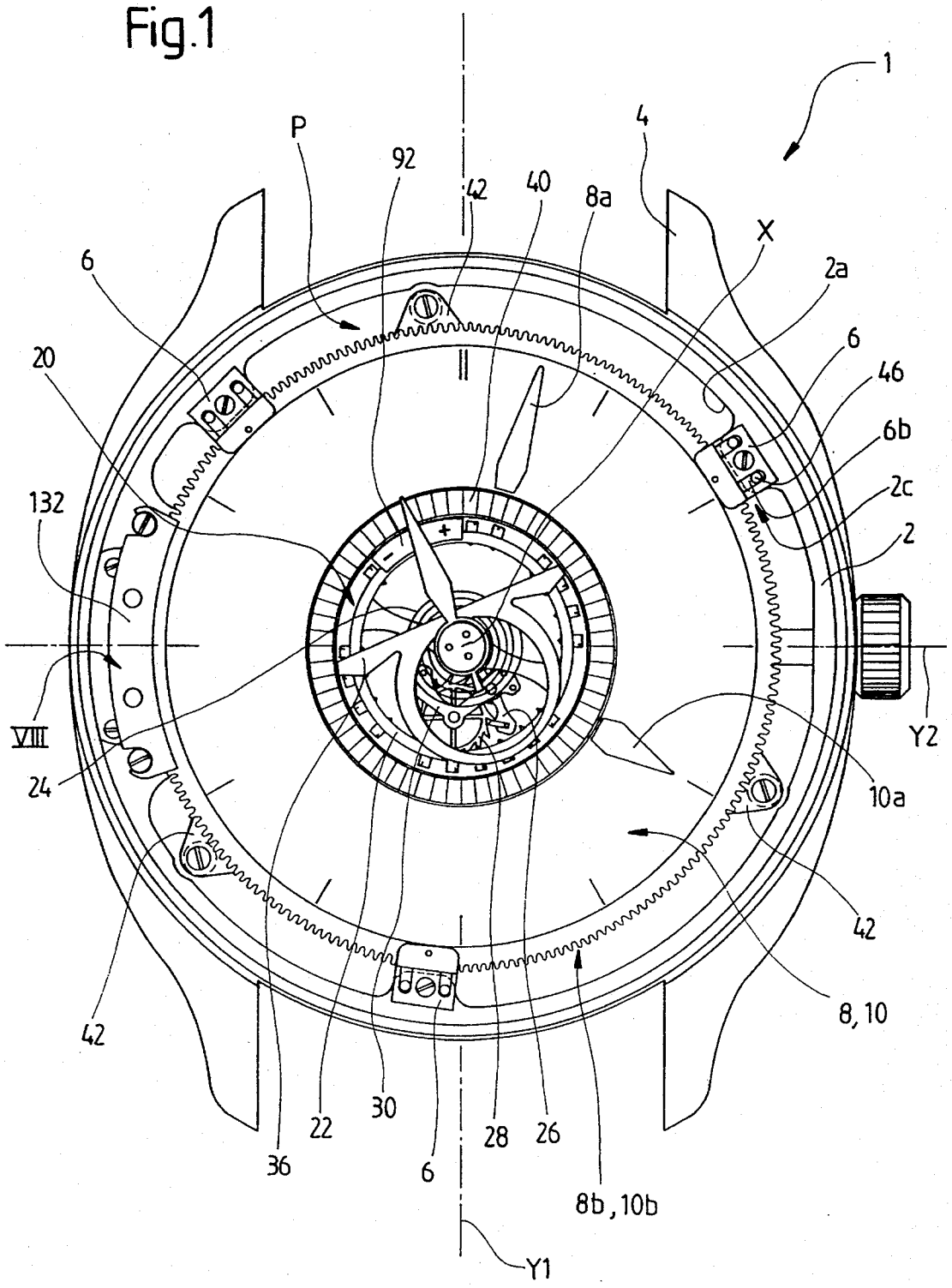
FIG. 1 is a top view of a timepiece according to the invention, in which the watch-glass and the fixed bezel have been removed for a better understanding of the drawing.
Figure 7:
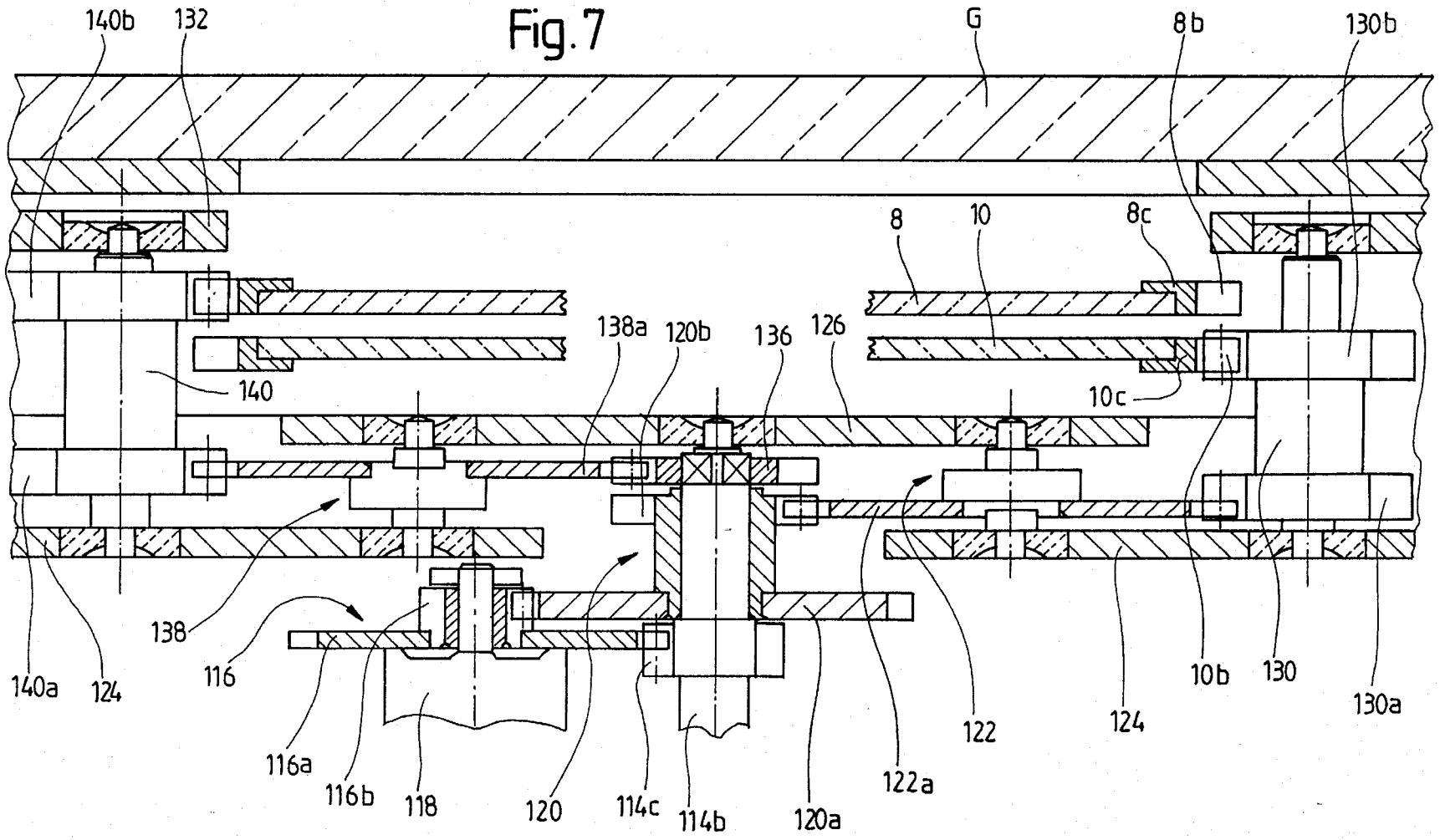
Figure 8:
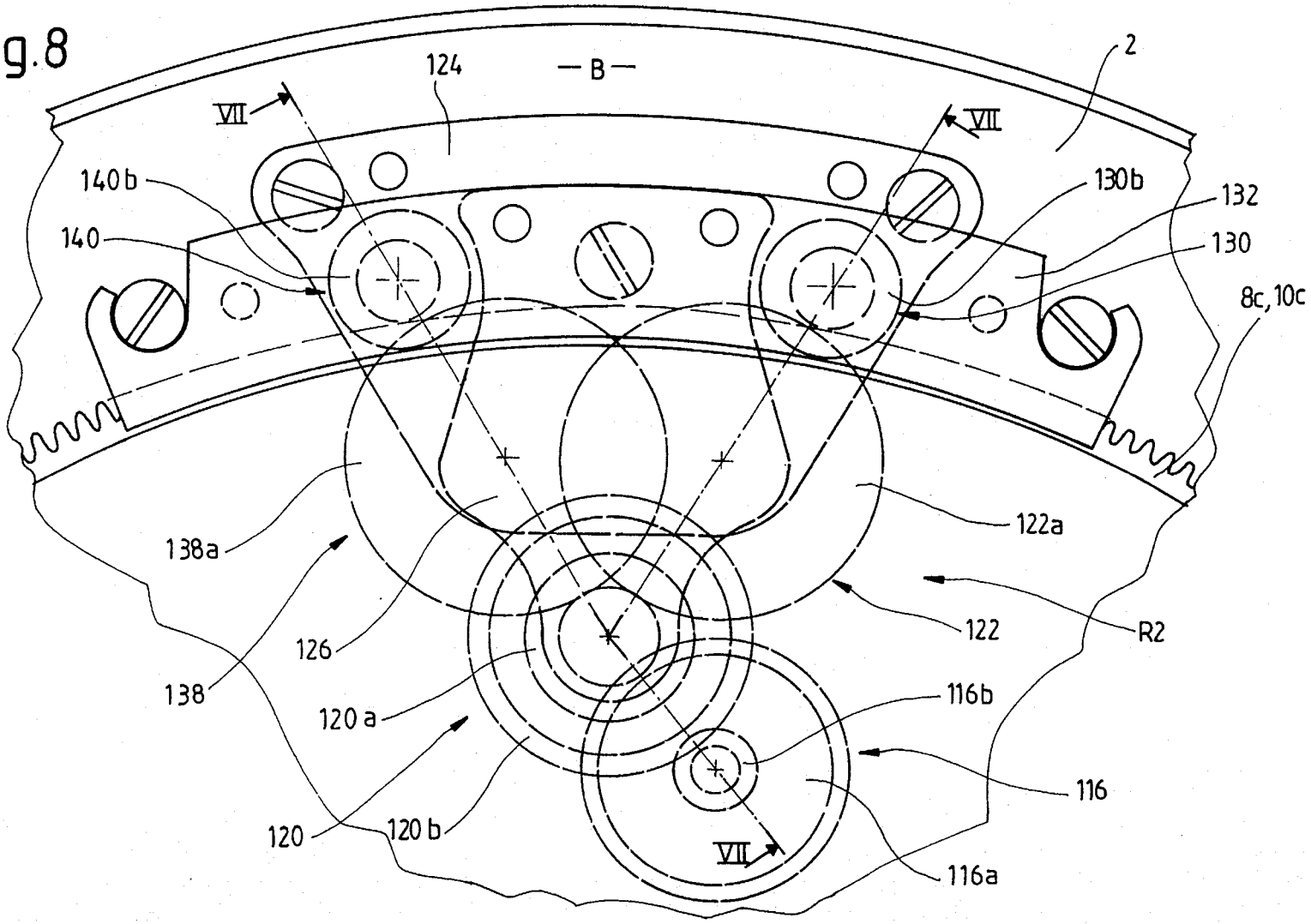

FIG. 7 is a cross-sectional view shown along the line VII—VII of FIG. 8, showing more particularly the wheel and pinion sets and the bars of the disc driving device, mounted on the case of said timepiece, these elements having been brought into a same plane for the purposes of the drawing; and FIG. 8 is a top view shown along the arrow VIII of FIG. 1, showing the above-mentioned driving device, the dial having been removed from this figure in order to reveal this system's wheel and pinion sets.

As is seen in FIG. 1, the timepiece according to the invention which is represented here by the general reference 1 comprises a case 2 from which horns 4 (only one being referenced), intended for attaching a wristlet, extend in a conventional manner.

As will emerge during the following description, this case 2 also has an essential mechanical function of holding and positioning both the mobile and fixed horometrical components of timepiece 1. Close to the internal edge **2*a* of case 2, and more particularly on the radial protruding parts 2*c* extending integral with the latter, brackets referenced 6 (here three in number) are mounted in a fixed manner, forming part of a guide device for two superposed transparent indicator discs 8 and 10 (FIG. 3**) indicating respectively the hours and the minutes.

Thus, on minute disc 8 a minute hand **8*a* is formed by metallic deposit, while on hour disc 10 an hour hand 10*a*** is formed in the same manner.

Figure 3:
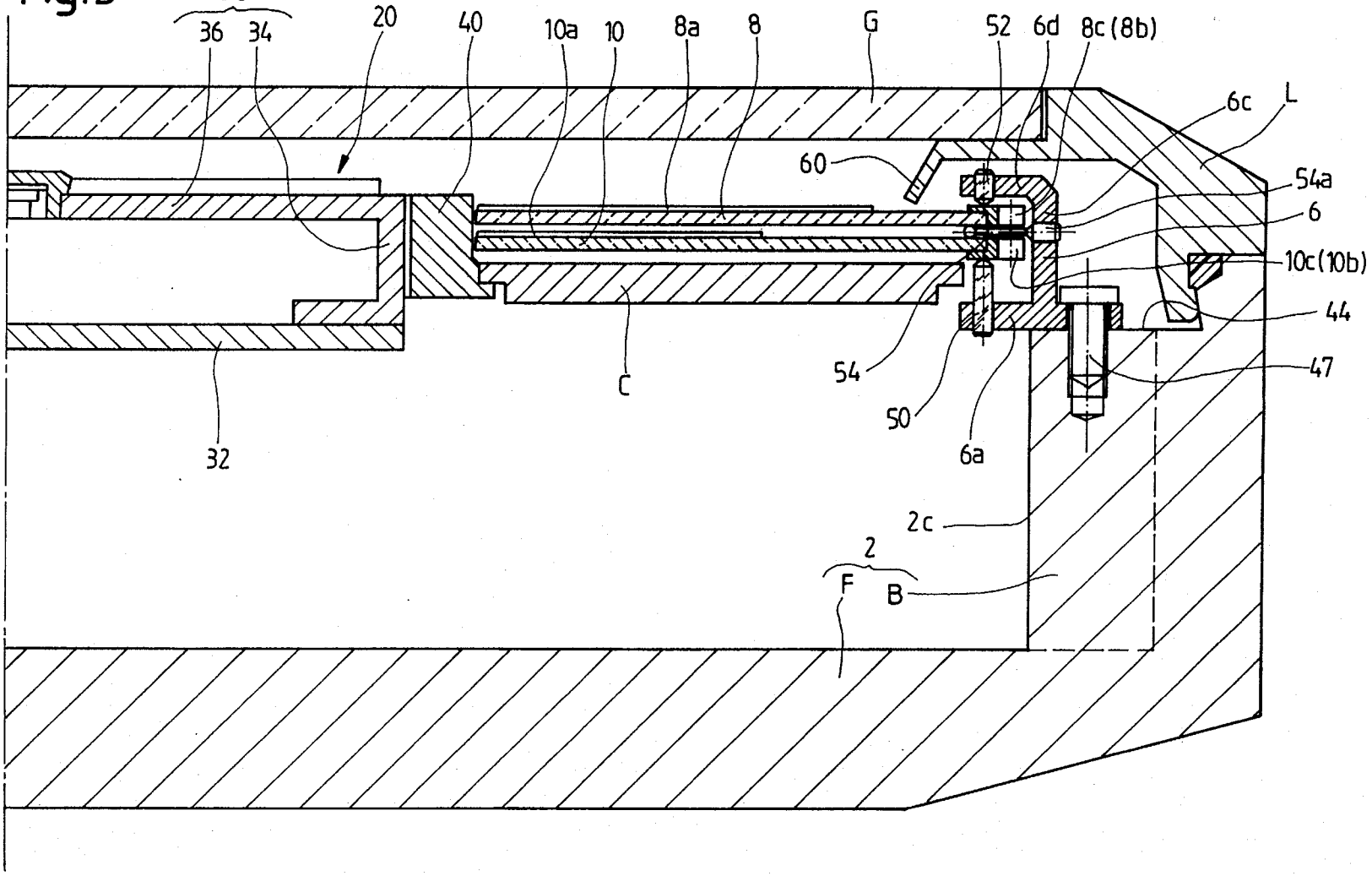
FIG. 3 is also a very schematical semi sectional view passing through the centre of the timepiece of FIG. 1 and showing more particularly the device for guiding the hour and minute indicator discs of this timepiece.

The two respective hour and minute discs 8 and 10 are driven at their periphery by external radial toothings respectively **8*b* and 10*b*, as is seen in a more detailed way in cross-section in FIG. 3. These two discs 8 and 10** also comprise a central orifice, not referenced, which gives them an annular shape.

As a result of these peripheral toothings **8*b* and 10*b* the two respective hour and minute discs 8 and 10 are driven by a mechanical driving device of this timepiece 1** whose essential peculiarity is that it comprises a tourbillon, and notably a pallet escapement tourbillon arranged at the centre of said timepiece.

Figure 2:
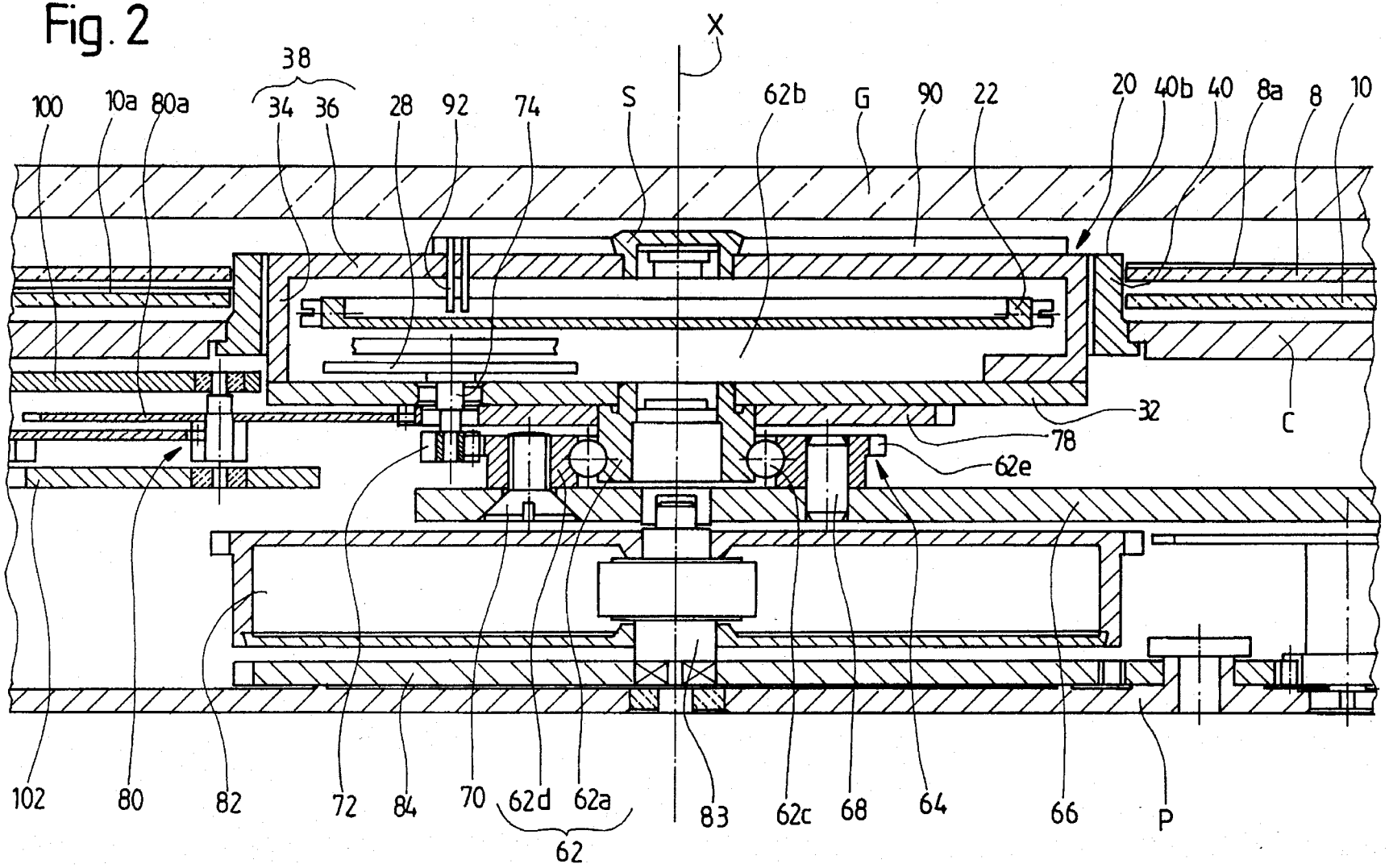
FIG. 2 is a cross-sectional view of the timepiece of FIG. 1, passing through the centre, and showing in a schematical way the assembly of the tourbillon on a tourbillon bar upon which a barrel is pivoted, which is mounted coaxially to said tourbillon.

This central tourbillon which carries the general reference 20 comprises a conventional moving set of components, namely a balance wheel 22 which is shown schematically in FIG. 2, a balance-spring 24, a pallet 26 and an escapement wheel 28 pivoted on an escapement bar 30. The arrangement of these components on tourbillon 20 and their working is conventional, consequently it will not be described here in more detail. For further information, one can refer to the work entitled "Das Tourbillon" by Reinhard Meis, Peter Ineichen edition, Zurich.

Tourbillon 20 is mounted so as to be rotatably mobile around its longitudinal axis referenced (FIG. 2) which is also the central longitudinal axis of timepiece 1 (situated at the intersection of the transversal axes 6*h*–12*h* (referenced Y1) and 3*h*–9*h* (referenced Y2), a characteristic geometrical axis around which the hour and minute indicators respectively 10*a* and 8*a* rotate supported by discs 8 and 10. In conventional timepieces it is around this central axis X that the hour and minute hands and possibly the second hand rotate.

As is seen in FIG. 2, tourbillon 20 comprises a base 32 which is also rotatably mobile around central axis X and which acts as support to most of the components with which tourbillon 20 is equipped. It will be noted that, from this base 32, axial arms 34 (here three in number) rise in the direction of a glass G, fixed to base 32 and connected to each other by transversal arms 36 which join near to central axis X. Axial arms 34 and transversal arms 36 constitute as far as function is concerned a cage 38 which "encloses", in cooperation with base 32, the components of tourbillon 20 housed inside the latter.

As is seen in FIGS. 1 and 2, this tourbillon 20 and more particularly cage 38 turn freely with a significant radial play inside a dial ring 40 which has the form of a tube or hollow pipe and which is driven into a dial C.

Dial C which is placed under display discs 8 and 10 is held firm, by screws which are not referenced, on a plate P (visible in FIG. 2) via three columns 42 (FIG. 1) driven into this plate. This dial C carries visible time indications through two discs 8 and 10, for reading the time provided by timepiece 1.

It is thus understood that dial ring 40 is held in a fixed position on timepiece 1 and that it is fixed in relation to case 2. Further, it can be seen in FIGS. 2 and 3 that this dial ring 40 comprises a straight external wall 40*b* which enables it to ensure the rotational radial guiding of the two display discs 8 and 10 which are thus mounted, in relation to this straight wall 40*b* with a radial play such that these superposed discs 8 and 10 can rotate freely around this dial ring 40 and thus around tourbillon 20. Dial C and dial ring 40 thus together constitute a principal component of timepiece 1 by ensuring the radial part of the rotational guiding (internal guiding) of the hour and minute indicators formed by discs 8 and 10. Dial C is thus designed, notably in thickness to be able to guarantee this precise positioning.

It is to be noted here that the two transparent minute and hour discs 8 and 10 are made of a mineral material, such as sapphire. As has been noted above, the two hour and minute hands respectively 8*a* and 10*a* are arranged on these sapphire discs, as additional thickness, by deposit of a metallic layer, in accordance with conventional methods. These additional thicknesses have been shown in an exaggerated manner in FIG. 3 for a better understanding of the drawing. Of course, the designs affixed to these discs are not limited only to the hands mentioned above.

The two display discs 8 and 10 are further guided in height (axial guiding) at their periphery by brackets 6, one of which will be described in more detail with reference to FIG. 3.

Each bracket 6 has a U shape of which one of the arms, the lower arm, referenced 6*a* extends laterally towards the exterior of case 2 so as to cover a shoulder 44 of this case, formed by the upper surface of one of radial protruding parts 2*c* of case 2.

As far as function is concerned, this case 2 by ensuring the axial guiding of hour and minute indicating means 10 and 8 constitutes a frame referenced B. In the example shown, this frame B is integral with a back F of case 2, a back on which an oscillating mass, which is not shown, pivots.

The longest transversal arm 6*a* of bracket 6 comprises positioning slots 6*b* (only one being referenced here, FIG. 1) each receiving a pin 46 driven into the frame forming part B of case 2, and notably into the corresponding protruding part 2*c*. Each bracket 6 is fixed rigidly to case 2 via a screw 47 also anchored in said case 2.

From the longest transversal arm 6*a* acting as base for bracket 6, an axial arm 6*c*, which is extended by a second transversal arm 6*d*, extends upwards towards watch-glass G and more particularly towards a fixed bezel L; the three branches 6*a*, 6*c* and 6*d* of bracket 6 constituting the U shaped opening mentioned above, which is open in the direction of display discs 8 and 10. The three U shaped radial openings thus formed by the three brackets 6 receive discs 8 and 10.

The two display discs 8 and 10 comprise at their periphery crowns 8*c* and 10*c* formed of a metallic material, and comprising a shoulder enabling the corresponding disc to be received. Driving crowns 8*c* and 10*c* are glued to display discs 8 and 10 and they comprise at their periphery the external radial toothing 8*b*, 10*b* shown in FIG. 1, a toothing which is machined directly in these crowns.

As will be understood below, due to their external toothing, these two driving crowns 8*c* and 10*c* enable the two display disc 8 and 10 to be driven in rotation with the aid of horometric elements which will be described below.

The two display discs 8 and 10 are guided in height (axial guiding) as a result of a sandwich structure formed of two rubies 50 and 52 extending axially facing crowns 8*c* and 10*c* and driven respectively inside transversal arms 6*a* and 6*d* of bracket 6. Thus, these two rubies 50, 52 which are placed on either side of the display assembly formed of the two transparent discs 8 and 10 rest in frictional contact, laterally against one of the flanks of the two driving crowns 8*c* and 10*c*.

Further, between the two display discs 8 and 10 a spacer or cross-brace 54 is inserted, having the form of a hand whose base 54*a* is driven into axial arm 6*c* of bracket 6 and whose head, here in spherical form, extends downwards in the direction of the centre of the timepiece, towards the centre of tourbillon 20, inside the space between the two display discs 8 and 10. As a result of this arrangement, one can ensure a permanent operating play of sufficient height between these discs 8 and 10.

It will also be noted that fixed bezel L which is mounted in a conventional manner by a cone on frame B of case 2 supports also in a conventional manner watch-glass G and comprises an annular roof 60 which extends downwards at an angle in the direction of display discs 8 and 10. This roof covers brackets 6 and the peripheral end of discs 8 and 10 and prevents the latter from being visible from outside the timepiece.

Referring henceforth to FIG. 2, the horometric components of timepiece 1 according to the invention will be described in more detail.

As is seen in this drawing, tourbillon 20 is rotatably mounted around its longitudinal axis X with the aid of a bearing 62 whose internal ring 62*a* is fixedly mounted onto base 32 of tourbillon 20.

Thus internal ring 62*a* of bearing 62 constitutes guide means for guiding tourbillon 20 in rotation around central axis X of timepiece 1.

More particularly, this internal ring 62*a* of bearing 62 is driven into base 32 of tourbillon 20 and it comprises, inside the latter, a setting 62*b* shown here very schematically and in which a jewel is placed, not referenced, ensuring the guiding of balance-wheel 22 in rotation. It will be noted that balance-wheel 22 is further guided in its upper part by a jewel, not referenced, placed in a support S attached to transversal arms 36 of cage 38.

Bearing 62 comprises in the conventional manner a set of balls 62*c* (only one of which is referenced), as well as an external ring 62*d* which, in an advantageous manner, comprises an external toothing 62*e* constituting a fixed wheel 64 of tourbillon 20. External ring 62*d* of bearing 62 is fixed onto a tourbillon bar 66 which is further, fixed (in a way not shown) to plate P of timepiece 1, a plate which is positioned above the oscillating mass which is not shown and which is fixed onto the back-frame formed by case 2.

External ring 62*d* of bearing 62 is positioned precisely on tourbillon bar 66 with the aid of pins 68 (here two in number) driven in the conventional manner into these two elements. The axial attachment of this external ring 62*d* and consequently of tourbillon 20 as a whole, is ensured, on tourbillon bar 66, with the aid of screws 70, here 3 in number, and of which only one has been shown in this drawing.

It will thus be understood from what has just been described that tourbillon 20 is rotatably mounted at the centre of timepiece 1 by means of a single pivot (guiding in rotation in a single pivoting plane) formed by ball bearing 62. A suspended assembly cantilever structure has thus been achieved, without an upper bar, for it can be noted that from the side of glass G, tourbillon 20 is free from any mechanical coupling since it is not connected to any additional guiding element. This arrangement is extremely advantageous as it enables tourbillon 20 to be positioned with a small end play in relation to glass G and it completely frees the upper part of said tourbillon. Further, the latter, being mounted at the centre of timepiece 1, may comprise diametrical dimensions greater than an eccentric assembly. It can be noted that in the extreme, tourbillon 20 could occupy almost all the available surface of timepiece 1.

As is seen in FIG. 2, the external peripheral toothing of external ring 62*d* of bearing 62, which constitutes fixed wheel 64 of tourbillon 20, meshes with a pinion 72, called the escape-pinion.

This escape-pinion 72 is rotatably mounted on base 32 of tourbillon 20 via a traversing axis 74 which is housed in an unreferenced jewel, placed in said base 32. Traversing axis 74 forms a protruding part on either side of base 32 and it is connected to escapement wheel 28, a top view of which is seen in FIG. 1. Consequently, the rotation of tourbillon 20 and in particular base 32 around central axis X via the sole monoplane support provided by ball bearing 62 enables escapement wheel 28 to be driven in rotation, via escape-pinion 72 which here forms a satellite pinion. This driving of escapement wheel 28 ensures the beat of pallet 26, which, in the conventional manner, enables the alternating oscillating movement of balance wheel 22 to be maintained.

It is to be noted here that tourbillon 20 comprises in addition a cage wheel 78 which is fixed by screws not shown under base 32 and which meshes with an intermediate wheel and pinion set 80 forming part of a first gear-train R1 shown in FIG. 4, ensuring the direct mechanical coupling between a barrel 82 which will be described below and tourbillon 20, Barrel 82 which is arranged between plate P and tourbillon bar 66 is of conventional design as regards its structure and operation. The axis 83 of this barrel 82 is rotatably mounted on plate P and in tourbillon bar 66 by means of conventional bearings which are not referenced. It will be noted that barrel 82 is mounted directly above tourbillon 20 and coaxially with the latter, that is to say also on central longitudinal axis X of timepiece 1. Thus, as a result of this advantageous arrangement of the barrel at the centre, said barrel can have diametrical dimensions greater than an eccentric assembly and, in the extreme, barrel 82 could, like tourbillon 20, occupy almost all the available surface of timepiece 1, and extend beyond the external diameter of the movement.

Barrel 82 drives in the conventional manner a ratchet 84 which receives the energy from an oscillating mass which is not shown, housed under the plate. It is to be noted here that tourbillon bar 66 provided with tourbillon 20 together with the other intermediate wheel and pinion set 80 constitute on plate P a completely separate module which is mounted on the back-frame of case 2, above the oscillating mass, a module which, in itself, and provided that it meshes mechanically with a driving element, may function independently of barrel 82.

It is also to be noted in FIG. 2 that transversal arms 36 which constitute cage 38 of tourbillon 20 carry an index 90 which is pivotally mounted on support S and which comprises setting pins 92 (only one of which is referenced) capable of acting on balance-spring 24 shown in FIG. 1. Balance-spring 24 is itself mounted with the aid of a balance-spring stud on transversal arms 36 of cage 38. This assembly, known as a Breguet assembly, is conventional and will not be described in more detail.

It is to be noted simply that the angular movement of index 90 in relation to cage 38 of tourbillon 20 enables the rate of timepiece 1 to be set and thus its accuracy to be adjusted.

In a very advantageous manner, index 90 forms the second hand of timepiece 1, the horometric components described here being provided so that tourbillon 20 completes a revolution in one minute.

Consequently, a tourbillon supporting a second hand at the centre, has been provided, whose rotation is not disturbed by any additional supporting obstacle. One can also note that the upper part of dial ring 40 may comprise graduations of the seconds to enable the seconds to be read via the second hand formed by index 90. As is also seen in FIG. 1, this second hand 90 is placed above an index support 92 on which can be marked the indications+ (plus) and– (minus) used for adjusting the rate.

Figure 4:
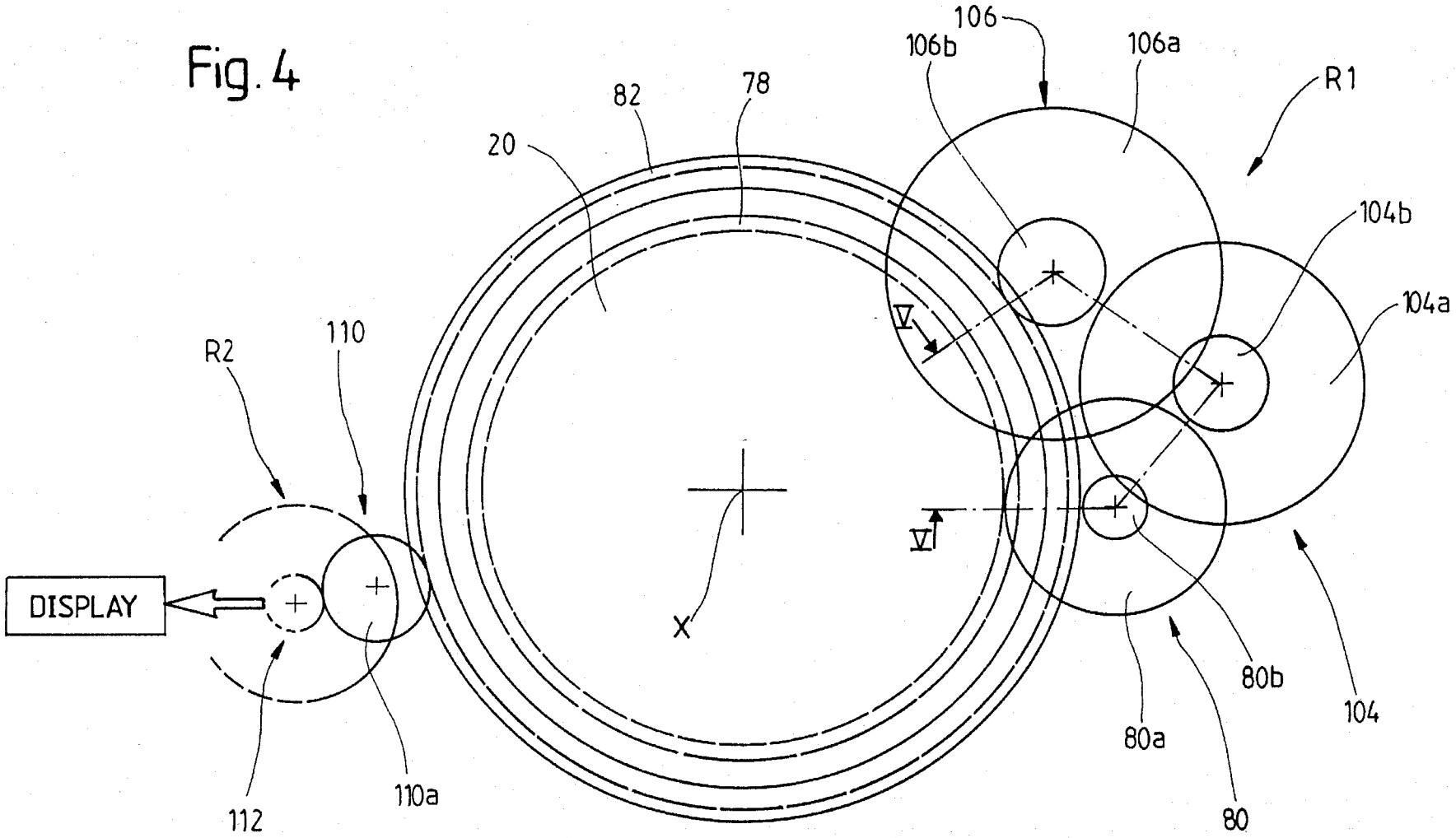
FIG. 4 is a schematical top view of the tourbillon and the barrel, used with a first driving gear-train and a second display gear-train represented solely by these first-wheel and pinion sets.

Referring now to FIG. 4, gear-train R1, which ensures the direct mechanical coupling between barrel 82 and tourbillon 20, will be described below.

Figure 5:
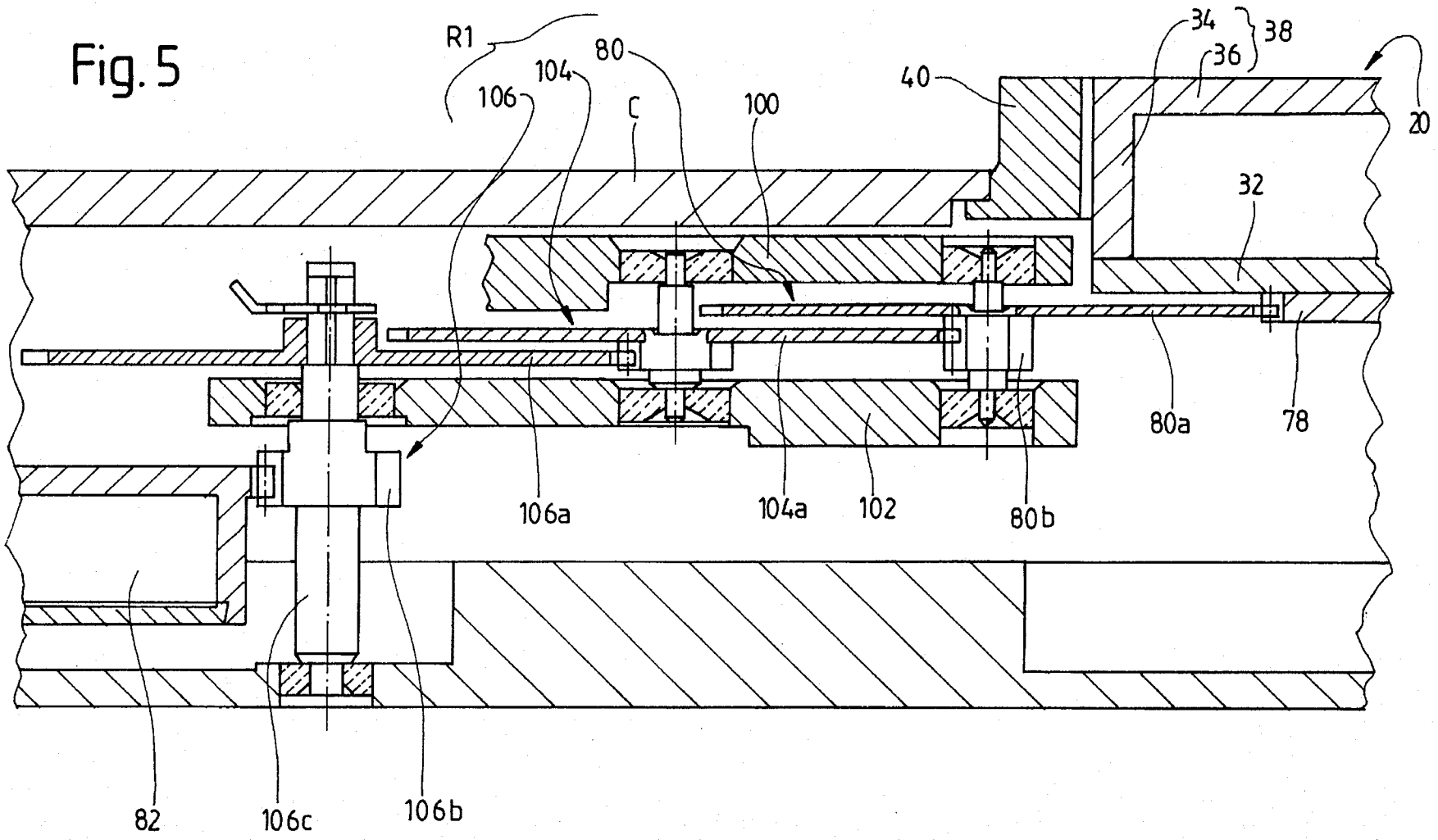
FIG. 5 is a cross-sectional view along the line V—V of FIG. 4, showing in a more detailed way the wheel and pinion sets of the driving gear-train connecting the tourbillon to barrel.

As has already been mentioned above, a wheel 80*a* of a wheel and pinion set 80 meshes with the cage wheel 78 of tourbillon 20, this wheel and pinion set 80 being rotatably mounted between two bars, respectively an upper bar 100 and a lower bar 102, attached to plate P. It is to be noted here that the upper bar 100 is mounted on the lower bar 102 which is in turn mounted on plate P, these construction details not being shown here. These two bars 100 and 102 and the wheel and pinion sets of gear-train R1 are particularly visible in FIG. 5, and partially in FIG. 2. It is to be noted that FIG. 5 is a view which has been opened out for a better understanding of the drawings but which does not accurately represent barrel 82 which is actually situated facing tourbillon 20.

Wheel and pinion set 80 also comprises a pinion 80*b* which meshes with a wheel 104*a* of a second wheel and pinion set 104 of gear-train R1. This wheel and pinion set 104 comprises a pinion 104*b* meshing with a wheel 106*a* of a third wheel and pinion set 106, this wheel and pinion set 104 also being rotatably mounted between the two bars 100 and 102. Finally, wheel and pinion set 106 is provided with a pinion 106*b* which meshes with the toothing of barrel 82. As is seen in FIG. 5, wheel and pinion set 106 comprises an arbor 106*c* which is rotatably mounted in plate P and in lower bar 102 which it traverses.

Figure 6:
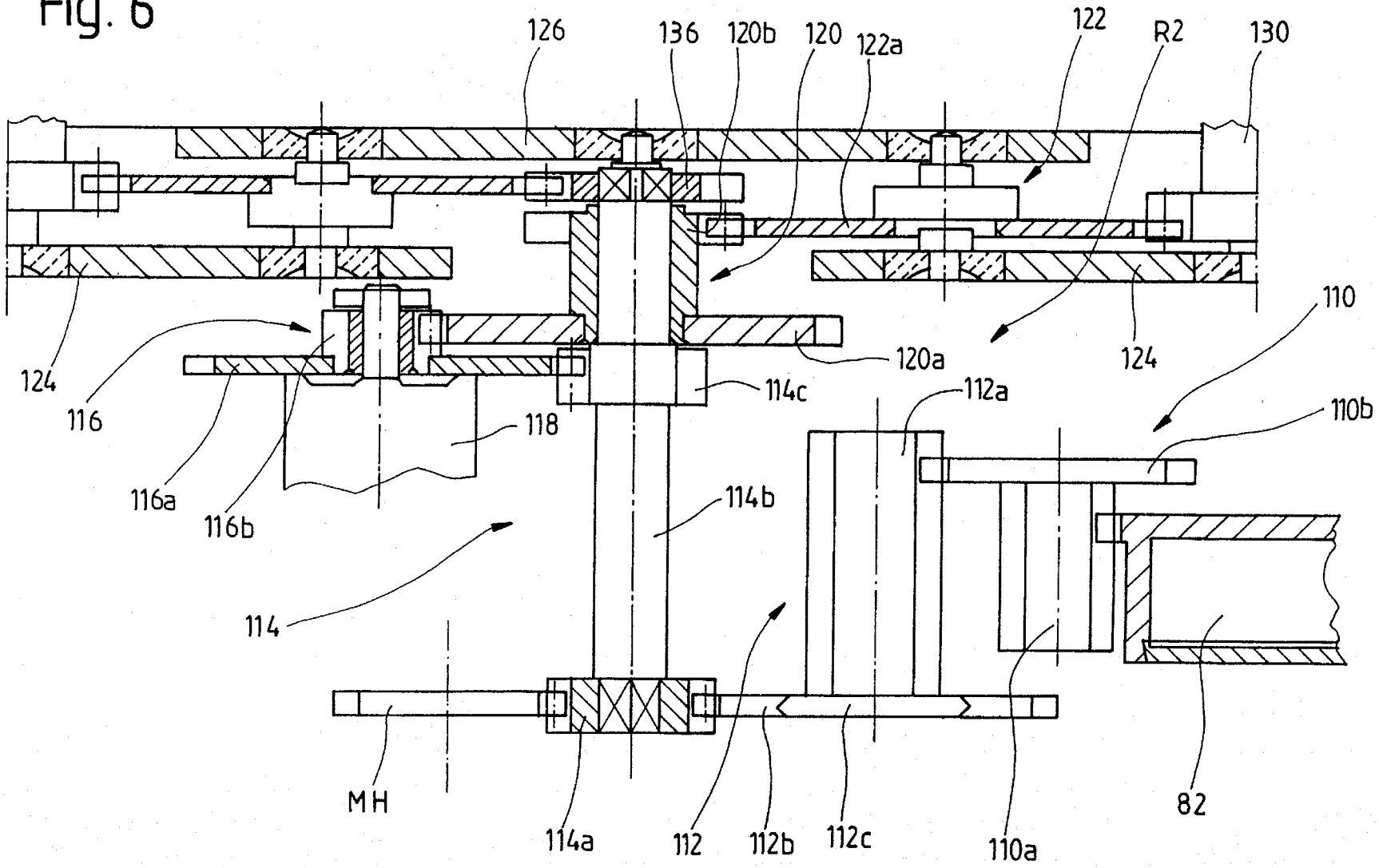
FIG. 6 is a cross-sectional view of the display gear-train directly connecting the barrel to the display disc driving device of the timepiece according to the invention.

Further as is seen in FIG. 6, barrel 82 drives a second gear-train R2 which ensures the driving of display discs 8 and 10.

This second gear-train R2 comprises a first wheel and pinion set 110 whose pinion 110*a* meshes with the toothing of barrel 82, and whose wheel 110*b* meshes with a pinion 112*a* of a second wheel and pinion set 112 of gear-train R2. Wheel and pinion set 112 comprises a wheel 112*b* frictionally mounted on arbor 112*c* of said wheel and pinion set 112, in order to effect the time setting of display discs 8 and 10.

Wheel 112*b* meshes with a pinion 114*a* of a control wheel and pinion set 114 shown in more detail in FIG. 7. Pinion 114*a* also meshes with a time setting pinion MH capable of being controlled by the user.

As can be seen more particularly in FIG. 7, this control wheel and pinion set 114 comprises an arbor 114*b* on which is arranged another pinion 114*c* which in turn meshes with a wheel 116*a* of a motion-work 116 ensuring the reduction for driving hour disc 10 in rotation, at the rate of one revolution every twelve or twenty-four hours.

Motion-work 116 is mounted on a stud 118 attached to plate P, which is not shown here.

Said motion-work 116 comprises a pinion 116*b* which meshes with a wheel 120*a* of a wheel and pinion set 120*a* which is freely mounted on control arbor 114*b* and which carries a pinion 120*b* meshing with a wheel 122*a* of an intermediate wheel and pinion set 122 pivoted between two bars 124 and 126. This intermediate wheel and pinion set 122 drives an hour wheel and pinion set 130 which is rotatably mounted between bar 124 and a third bar 132, visible in top view in FIGS. 1 and 8.

Hour wheel and pinion set 130 is a tiered wheel and pinion set whose lower pinion 130*a* meshes with wheel 122*a*, while the upper pinion 130*b* meshes with hour disc 10 via the peripheral toothing of added crown 10*c*.

Control arbor 114*b* further comprises an inserted pinion 136 driven by arbor 114*b* by a square coupling, this pinion meshing with a wheel 138*a* of another intermediate wheel and pinion set 138 rotatably mounted between the two bars 124 and 126. Wheel 138*a* also meshes with a lower pinion 140*a* of a minute wheel and pinion set 140, which has a tiered structure identical to that of hour wheel and pinion set 130.

Minute wheel and pinion, set 140 comprises an upper pinion 140*b* driving minute disc 8, via the peripheral toothing of added crown 8*c*. It will be noted here that the two discs 8 and 10 are of identical shape and size, as are the two crowns 8*c* and 10*c*.

Hour wheel and pinion set 140 is also rotatably mounted between the two bars 132 and 124. The three bars 124, 126 and 132 are particularly visible in FIG. 8 which shows in top view the display disc driving arrangement which has just been described. In FIG. 8, dial C has been removed for a better understanding of the drawing, which makes display gear-train R2 particularly visible.

It is to be noted here that the three bars of this system are mounted on the annular wall of case 2, forming frame B and that, with the hour and minute wheel and pinion sets 130 and 140 and with the two intermediate wheel and pinion sets 122 and 138, they form a particular module added to case 2.

It is also to be understood that second gear-train R2 does not mesh directly with first gear-train R1 connecting barrel 82 to tourbillon 20. These two gear-trains both depart directly from barrel 82. Thus, the time setting action which can be achieved via time setting pinion MH (FIG. 6) has no appreciable influence on second gear-train R2, so that tourbillon 20 is not disturbed by this adjustment. One has thus two gear-trains which are isolated by the intervention of barrel 82, namely driving gear-train R1 and display gear-train R2.

What is claimed is:

1. A mechanical timepiece comprising a barrel meshing with a tourbillon, wherein said tourbillon having a base and an escape-pinion formed by a satellite pinion which meshes with a fixed toothed wheel located below said base, wherein said tourbillon is rotatably mounted inside said timepiece on a single pivot supporting said tourbillon by its base, said tourbillon being suspended by its lower part on said single pivot, and being completely free in its upper part.

2. A mechanical timepiece comprising a dial side, visible to a user for reading a horometric time, and a barrel meshing with a tourbillon, wherein said tourbillon is made visible from the dial side of the timepiece and is arranged at the centre of said timepiece.

3. A timepiece according to claim 2, wherein said tourbillon completes a revolution in one minute and comprises a second hand which forms a rate adjustment regulating index of said timepiece.

4. A timepiece according to claim 3, wherein it comprises display discs which indicate the horometric time and which are mounted coaxially in relation to said tourbillon.

5. A timepiece according to claim 4, wherein it comprises a dial ring fixedly mounted in a display dial, this ring forming guide means ensuring rotational radial guiding of the display discs.

6. A timepiece according to claim 5, wherein the display discs are driven at their periphery by a driving device mounted on a frame formed by a case of said timepiece.

7. A timepiece according to claim 4, wherein it comprises toothed driving crowns which are fitted respectively at the periphery of the display discs.

8. A timepiece according to claim 4, wherein it comprises means for supporting the display discs, formed by brackets ensuring the axial guiding of said discs.

9. A mechanical timepiece comprising a barrel meshing with a tourbillon, wherein said tourbillon is supported by its base solely by a bearing whose external ring comprises a toothing which acts as a fixed wheel for driving a satellite pinion of an escapement of said tourbillon.

10. A mechanical timepiece comprising a barrel meshing with a tourbillon, and means for displaying an horometric time, wherein it comprises a first gear-train forming the driving gear-train and ensuring the mechanical coupling between the barrel and the tourbillon, and a second gear-train forming the display gear-train driving the display means, this display gear-train meshing with time setting means, the first driving gear-train and the second display gear-train both meshing directly with the barrel which constitutes between said gear-trains a mechanical buffer avoiding any disturbance of the first gear-train when the time is being set.

* * * * *